US006718580B2

(12) United States Patent
Heimbrock et al.

(10) Patent No.: US 6,718,580 B2
(45) Date of Patent: Apr. 13, 2004

(54) STRETCHER HAVING PIVOTABLE AND LOCKABLE PATIENT SUPPORT SECTIONS

(75) Inventors: Richard H. Heimbrock, Cincinnati, OH (US); Jonathan D. Turner, Dillsboro, IN (US); D. Scott Manlove, Odgood, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 10/359,987

(22) Filed: Feb. 6, 2003

(65) Prior Publication Data

US 2003/0115674 A1 Jun. 26, 2003

Related U.S. Application Data

(63) Continuation of application No. 09/675,911, filed on Sep. 29, 2000, now Pat. No. 6,578,215.

(51) Int. Cl.[7] ..... A61G 7/015; A61G 13/08; A61G 13/12

(52) U.S. Cl. ..... 5/617

(58) Field of Search ..... 5/617, 618, 600, 5/622, 613, 614, 616

(56) References Cited

U.S. PATENT DOCUMENTS

| | | | |
|---|---|---|---|
| 477,449 | A | 6/1892 | Pirrung et al. |
| 1,626,091 | A | 2/1927 | Macklin |
| 2,042,399 | A | 5/1936 | Holme |
| 2,258,782 | A | 10/1941 | McKean |

(List continued on next page.)

FOREIGN PATENT DOCUMENTS

| | | |
|---|---|---|
| DE | 3538887 A1 | 5/1986 |
| FR | 2 547 195 | 12/1984 |
| FR | 2 585 240 | 1/1987 |
| GB | 754052 | 8/1956 |

(List continued on next page.)

OTHER PUBLICATIONS

Reliance M–701 Surgical Stretcher, "Mobile Surgical Stretcher" 2 pages, date unknown.

Models 878,678 & 675, Uni–Care Mobile Surgical Stretchers, p. 14, date unknown.

Husted, "Products for Head and Neck Surgery," 4 pages, date unknown.

Stryker Patient Handling, "Head/Neck Surgery Stretcher Model 1067," 2 pages, Dec. 1992.

Stryker Patient Handling, "Extended Stay Stretcher Model 1550," 5 pages, Sep. 1993.

Stryker Patient Handling "Head & Neck Surgery Stretcher Model 1068," 6 pages, Sep. 1993, Oct. 1994.

*Primary Examiner*—Alexander Grosz
(74) *Attorney, Agent, or Firm*—Barnes & Thornburg

(57) ABSTRACT

An illustrative patient support apparatus includes a first section adapted to support a first portion of a patient, a second section adapted to support a second portion of the patient and pivotably movable relative to the first section about a first pivot axis, a third section adapted to support a third portion of the patient and pivotably movable relative to the second section about a second pivot axis that is parallel with the first pivot axis, a first locking mechanism that, when locked, prevents the second section from pivoting relative to the first section, a first lever that is movable to unlock the first locking mechanism to allow the second section to pivot relative to the first section, a second locking mechanism that, when locked, prevents the third section from pivoting relative to the second section, and a second lever that is movable to unlock the second locking mechanism to allow the third section to pivot relative to the second section.

40 Claims, 10 Drawing Sheets

U.S. PATENT DOCUMENTS

| | | | |
|---|---|---|---|
| 2,579,783 | A | 12/1951 | Branto |
| 2,972,505 | A | 2/1961 | Weickgenannt |
| 3,041,121 | A | 6/1962 | Comper |
| 3,176,975 | A | 4/1965 | Johnson et al. |
| 3,188,079 | A | 6/1965 | Boetcker et al. |
| 3,226,106 | A | 12/1965 | Burzlaff et al. |
| 3,227,440 | A | 1/1966 | Scott |
| 3,304,116 | A | 2/1967 | Stryker |
| 3,411,766 | A | 11/1968 | Lanigan |
| 3,482,571 | A | 12/1969 | Behrendt |
| 3,572,835 | A | 3/1971 | Kees et al. |
| 3,733,620 | A | 5/1973 | Glintz |
| 3,858,937 | A | 1/1975 | Norris |
| 3,885,831 | A | 5/1975 | Rasmussen |
| 3,929,309 | A | 12/1975 | DeVore |
| 3,981,031 | A | 9/1976 | Schacht |
| 4,035,953 | A | 7/1977 | Bierlich |
| 4,222,131 | A | 9/1980 | Holdt et al. |
| 4,247,091 | A | 1/1981 | Glowacki et al. |
| 4,321,917 | A | 3/1982 | Campbell |
| 4,346,487 | A | 8/1982 | Holdt et al. |
| 4,377,161 | A | 3/1983 | Whitt |
| 4,390,011 | A | 6/1983 | Evans |
| 4,489,449 | A | 12/1984 | Failor et al. |
| 4,506,872 | A | 3/1985 | Westerberg et al. |
| 4,620,697 | A | 11/1986 | Pithon |
| 4,669,136 | A | 6/1987 | Waters et al. |
| 4,751,755 | A | 6/1988 | Carey, Jr. et al. |
| 4,881,728 | A | 11/1989 | Hunter |
| 4,882,797 | A | 11/1989 | Failor et al. |
| 4,974,903 | A | 12/1990 | Lipschitz et al. |
| 5,135,210 | A | 8/1992 | Michelson |
| 5,177,823 | A | 1/1993 | Riach |
| 5,207,716 | A | 5/1993 | McReynolds et al. |
| 5,233,713 | A | 8/1993 | Murphy et al. |
| 5,335,384 | A | 8/1994 | Foster et al. |
| 5,347,668 | A | 9/1994 | Manning |
| 5,427,436 | A | 6/1995 | Lloyd |
| 5,453,080 | A | 9/1995 | Mitchum, Jr. |
| 5,481,770 | A | 1/1996 | Ahlsten |
| 5,524,639 | A | 6/1996 | Lanier et al. |
| 5,575,026 | A | 11/1996 | Way et al. |
| 5,675,851 | A | 10/1997 | Feathers |
| 5,699,567 | A | 12/1997 | Sanders et al. |
| 5,916,189 | A | 6/1999 | Sullenperger et al. |
| 5,926,876 | A | 7/1999 | Haigh et al. |
| 6,076,208 | A | 6/2000 | Heimbrock et al. |

FOREIGN PATENT DOCUMENTS

| | | |
|---|---|---|
| JP | 35-19293 | 8/1960 |
| JP | 35-28580 | 10/1960 |
| JP | 39-32275 | 10/1964 |
| JP | 40-23833 | 10/1965 |
| JP | 42-1715 | 1/1967 |
| JP | 42-11267 | 6/1967 |
| JP | 46-21835 | 7/1971 |
| JP | 52-7276 | 3/1977 |
| JP | 53-74190 | 6/1978 |
| JP | 53-74191 | 6/1978 |
| JP | 58-127648 | 7/1983 |
| JP | 58-143753 | 8/1983 |
| JP | 61-226043 | 10/1986 |

STRETCHER HAVING PIVOTABLE AND LOCKABLE PATIENT SUPPORT SECTIONS

CROSS-REFERENCE TO RELATED APPLICATIONS

This application is a continuation of U.S. patent application, Ser. No. 09/675,911, filed on Sep. 29, 2000, and entitled "SURGERY STRETCHER", now U.S. Pat. No. 6,578,215.

BACKGROUND AND SUMMARY OF THE INVENTION

The present invention relates to a hospital stretcher, and particularly, to a surgical stretcher used for eye surgery.

Hospital stretchers having head rests that support the head of a patient during eye, head, or neck surgery are known. For example, U.S. Pat. No. 6,076,208 issued to Heimbrock et al. describes a stretcher suitable for such surgeries, which patent is hereby incorporated herein in its entirety by reference. See also U.S. Pat. No. 4,882,797 to Failor et al. Many eye surgery procedures are done with the surgeon approaching a side of the patient while seated in a surgeon's chair. In addition, it is common for a microscope or other surgical equipment to be located above the patient's eye during eye surgery. Hence, there is a limited amount of space between a surgeon's lap and a microscope or other surgical equipment used by the surgeon during eye surgery. Therefore, surgeons would appreciate a surgical stretcher having a minimum amount of structure beneath the patient's shoulder, neck, and head area thereby permitting comfortable placement of the surgeon's legs beneath the patient while, at the same time, allowing ergonomic access to the surgical equipment located above the patient. In addition, it would be desirable for any stretcher controls used to adjust the position of the patient to be readily accessible to the surgeon while the surgeon is seated alongside the patient.

According to the present invention, a surgical stretcher includes a head rest configured to support a patient's head, a head frame configured to support a patient's shoulders, a back frame configured to support a patient's back, and a seat frame configured to support a patient's seat. The head rest is adjustably movable relative to the head frame. The head frame is adjustably movable relative to the back frame. The back frame is adjustably movable relative to the seat frame.

According to one aspect of the illustrative embodiment, the back frame defines a first, generally horizontal, upwardly facing support surface. The head frame angles upwardly to define a second, generally horizontal, upwardly facing support surface that is raised relative to the first, generally horizontal, upwardly facing support surface defined by the back frame to provide room for comfortable placement of the surgeon's legs beneath the patient.

According to another aspect of the illustrative embodiment, the stretcher includes a mattress seat portion supported on the seat frame, a mattress back portion supported on the back frame, a mattress shoulder portion supported on the head frame and a mattress head portion supported on the head rest. The thickness of the mattress shoulder portion is reduced relative to the thickness of the mattress back and seat portions so that upwardly facing top surfaces of the mattress shoulder, back and seat portions are generally coplanar.

According to a further aspect of the illustrative embodiment, the stretcher includes a back support shiftable longitudinally on the back frame. The head frame is carried on the back support for translation therewith, and is adjustably movable relative to the back support.

According to still another aspect of the illustrative embodiment, the stretcher includes a drive assembly for shifting the back support longitudinally on the back frame when the back frame is moved in relation to the seat frame. The back support shifts longitudinally away from the seat frame when the back frame is raised, and the back support shifts longitudinally toward the seat frame when the back frame is lowered.

According to a still further aspect of the illustrative embodiment, the mattress back, shoulder and head portions shift longitudinally away from the mattress seat portion when the back frame is raised, and the mattress back, shoulder and head portions shift longitudinally toward the mattress seat portion when the back frame is lowered. According to another aspect of the illustrative embodiment, the mattress back portion abuts the mattress seat portion when the back frame is lowered to a generally horizontal position. According to yet another aspect of the illustrative embodiment, the mattress back, shoulder and head portions are all connected to each other.

Additional features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
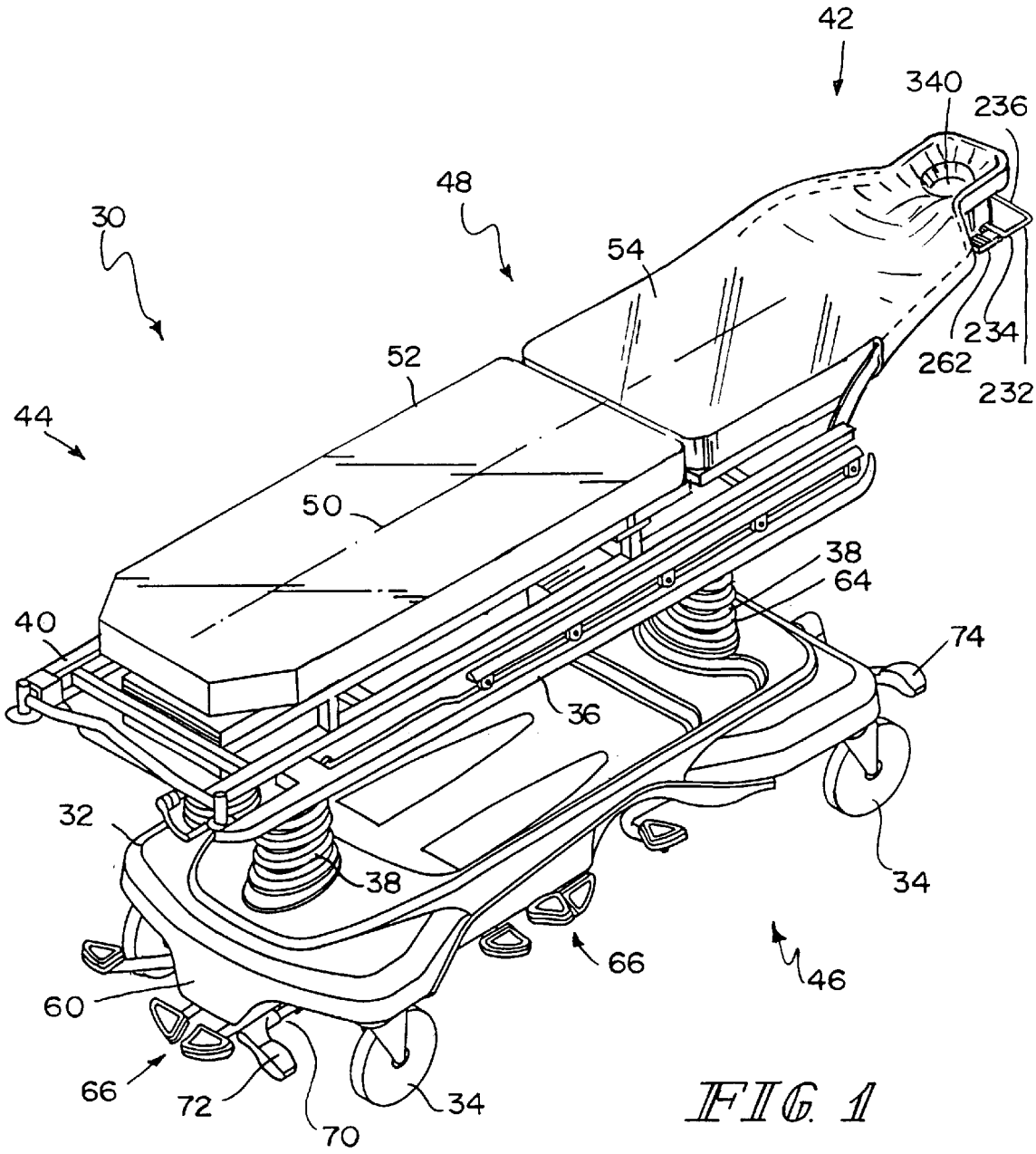
FIG. 1 is a perspective view of an illustrative eye surgery stretcher showing a base including a lower frame supported on casters, an intermediate frame supported above the base by a pair of longitudinally spaced-apart elevation mechanisms, an articulatable upper frame supported above the intermediate frame, the upper frame including a seat frame configured to support a patient's seat and legs, a back frame configured to support a patient's back, a head frame configured to support a patient's shoulders, and a head rest configured to support a patient's head, the back frame being pivotally coupled to the seat frame about a first transverse pivot axis, the head frame being pivotally coupled to the back frame about a second transverse pivot axis, and the head rest being pivotally coupled to the head frame about a third transverse pivot axis, and further showing a mattress seat portion supported on the seat frame, a mattress back portion supported on the back frame, a mattress shoulder portion supported on the head frame, and a mattress head portion supported on the head rest.

Referring to FIGS. 1–4, an illustrative eye surgery stretcher 30 includes a base 32 having a lower frame supported on casters 34, an intermediate frame 36 supported above the base 32 by a pair of longitudinally spaced-apart elevation mechanisms 38, and an articulatable upper frame 40 (sometimes referred to herein as upper deck or patient support deck) supported above the intermediate frame 36. The upper deck 40 has a head end 42, a foot end 44, first and second longitudinally-extending sides 46, 48 extending between the head end 42 and the foot end 44, and a longitudinal axis 50. The stretcher 30 includes a mattress 52 supported by the upper deck 40. The mattress 52 has an upwardly-facing patient-support surface 54 on which a patient can rest.

As used in this description, the phrase "head end 42" will be used to denote the end of any referred-to object that is positioned to lie nearest the head end 42 of the stretcher 30, and the phrase "foot end 44" will be used to denote the end of any referred-to object that is positioned to lie nearest the foot end 44 of the stretcher 30. Likewise, the phrase "first side 46" will be used to denote the side of any referred-to object that is positioned to lie nearest the first side 46 of the stretcher 30, and the phrase "second side 48" will be used to denote the side of any referred-to object that is positioned to lie nearest the second side 48 of the stretcher 30.

The base 32 is covered by a shroud 60. The casters 34 extend downwardly from the base 32 to engage a floor 62 on which the stretcher 30 rests. The elevation mechanisms 38, well-known to those skilled in the art, are each covered by a boot 64. The stretcher 30 includes a plurality of foot pedals 66 that are coupled to the elevation mechanisms 38. Different foot pedals 66 can be depressed to actuate the elevation mechanisms 38 to raise, lower, and tilt the intermediate frame 36 and the upper deck 40 supported thereon relative to floor 62.

The stretcher 30 also includes a longitudinally-extending brake-steer shaft 70. The brake-steer shaft 70 is coupled to a conventional caster braking (not shown) mechanism, well known to those skilled in the art. The caster braking mechanism brakes the casters 34 to prevent them from rotating and swiveling when the brake-steer shaft 70 is rotated to a braking position. The brake-steer shaft 70 is also coupled to a conventional center wheel steering mechanism (not shown), also well known to those skilled in the art. The center wheel steering mechanism presses a center wheel (not shown) into engagement with the floor 62 when the brake-steer shaft 70 is rotated to a steering position.

A brake pedal 72 is coupled to the brake-steer shaft 70 beneath the foot end 44 of the upper deck 40, and a butterfly pedal 74 is coupled to the brake-steer shaft 70 beneath the head end 42 of the upper deck 40. The brake pedal 72 can be engaged to rotate the brake-steer shaft 70 to the braking position. On the other hand, the butterfly pedal 74 can be engaged to rotate the brake-steer shaft 70 to the steering position and to the braking position. Reference may be made to the above-mentioned U.S. Pat. No. 6,076,208 issued to Heimbrock et al. and incorporated herein for further details.

Figure 5:
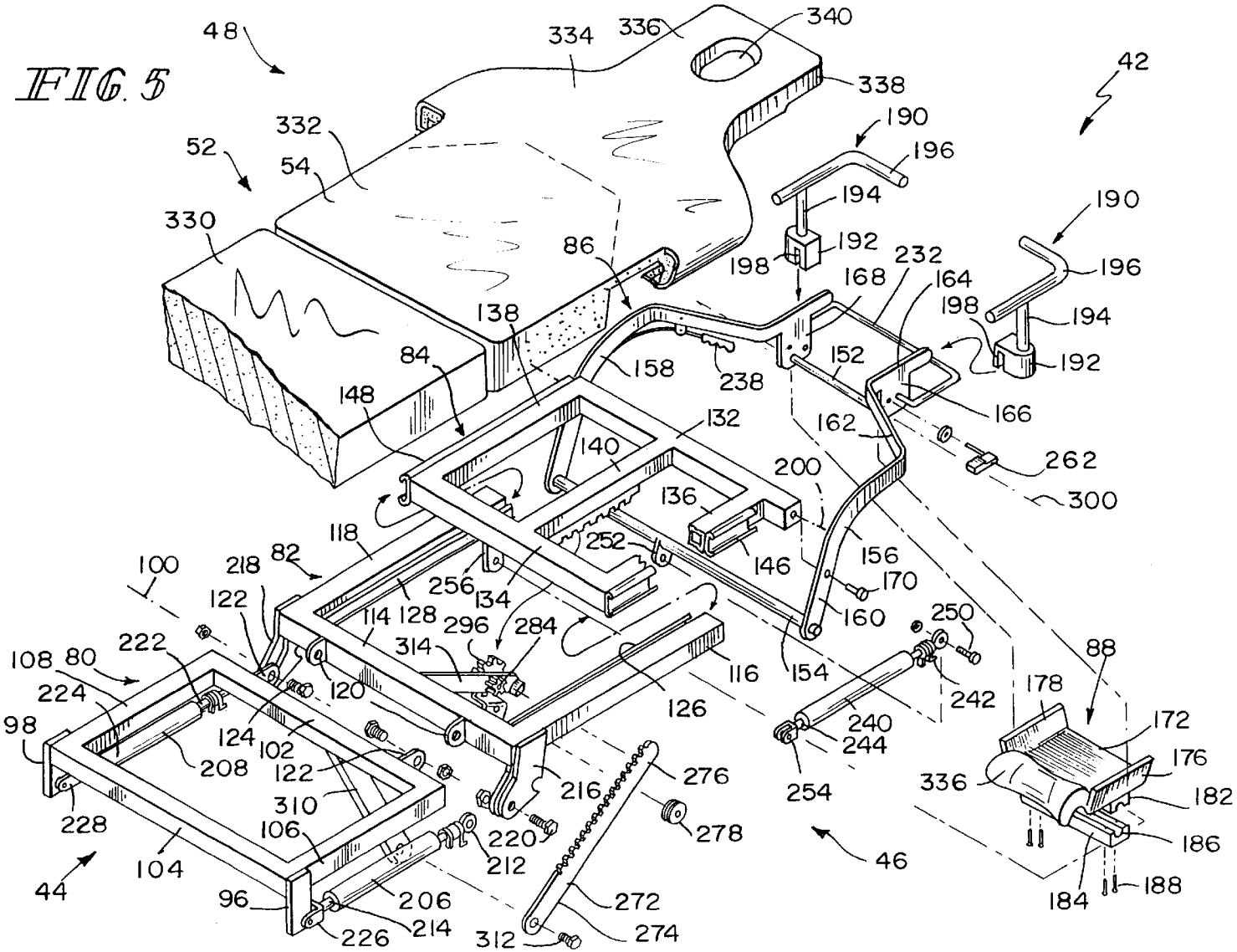
FIG. 5 is a partial exploded perspective view of the stretcher of FIG. 1 showing the seat frame, the back frame configured to be pivotally mounted to the seat frame about the first pivot axis, the back support configured to be translatably mounted on the back frame, the head frame configured to be pivotally mounted to the back support about the second pivot axis, the head rest configured to be pivotally mounted to the head frame about the third pivot axis, wrist supports configured to be mounted on forwardly-extending portions of the head frame, a drive assembly for extending the back support when the back frame is raised and for retracting the back support when the back frame is lowered, gas springs for releasably locking the back frame relative to the seat frame, a gas spring for releasably locking the head frame relative to the back support, a mattress seat portion supported on the seat frame, a mattress back portion supported on the back support, a mattress shoulder portion (also referred to herein as the mattress sling portion) supported on the head frame, and a mattress head portion supported on the head rest, the thickness of the mattress shoulder portion being reduced relative to the thickness of the mattress back and seat portions so that upwardly-facing surfaces of the mattress shoulder, back and seat portions are generally coplanar.
Figure 6:
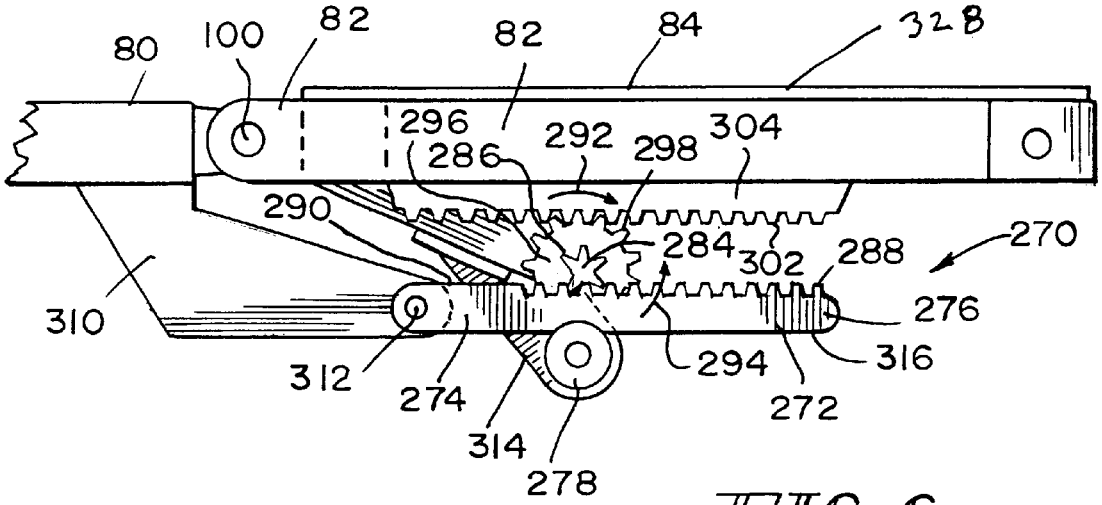
FIG. 6 is a partial side elevation view of the stretcher of FIG. 1 showing the seat frame, the back frame pivotally mounted to the seat frame about the first pivot axis, the back support shiftable on the back frame, the drive assembly for extending the back support when the back frame is raised and for retracting the back support when the back frame is lowered, the drive assembly including a first rack pivotally coupled to the seat frame and shiftably coupled to the back frame such that the first rack shifts longitudinally relative to the back frame when the back frame is pivoted with respect to the seat frame, a second rack coupled to the back support for motion therewith, and a pinion coupled to the first rack and coupled to the second rack such that the back support shifts longitudinally when the back frame is pivoted relative to the seat frame.
Figure 7:
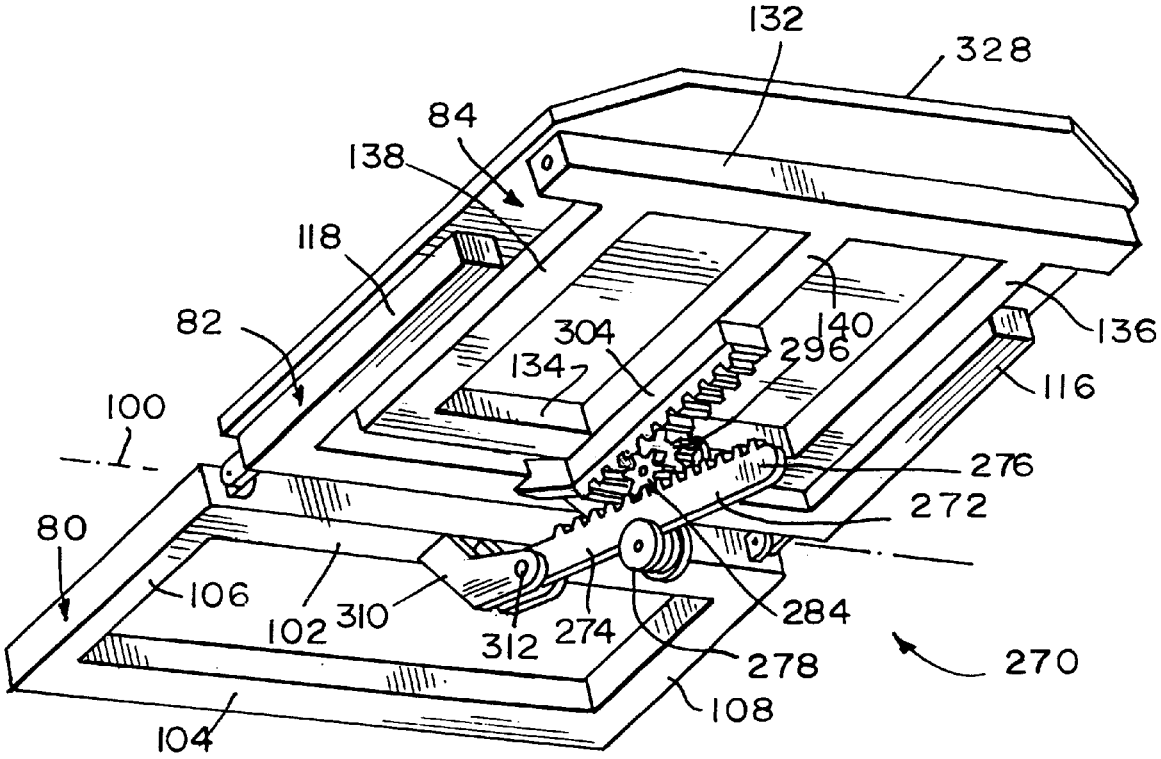
FIG. 7 is a bottom perspective view showing the drive assembly of FIG. 6 for extending the back support when the back frame is raised and for retracting the back support when the back frame is lowered.

Referring to FIG. 5, the upper frame 40 includes a seat frame 80 that supports a patient's seat and legs, a back frame 82 (sometimes referred to herein as lower back frame) pivotally coupled to the seat frame 80, a back support 84 (sometimes referred to herein as upper back frame) that is shiftably mounted on the back frame 82 and supports a patient's back, a head frame 86 that is pivotally coupled to the back support 84 and supports a patient's shoulders, and a head rest 88 (sometimes referred to herein as head cradle) that is pivotally coupled to the head frame 86 and supports a patient's head. The seat frame 80 is generally rectangular in configuration, and includes a transversely-extending cross member 102 near the head end 42, a transversely-extending cross member 104 near the foot end 44 and longitudinally-extending side members 106, 108 joining the head end and foot end cross members 102, 104. The seat frame 80 is rigidly mounted to the intermediate frame 36 by a pair of transversely spaced-apart plate members 96, 98 coupled to the foot end cross member 104.

As previously described, the back frame 82 is coupled to the seat frame 80 for pivoting movement about a first transverse pivot axis 100. The back frame 82 has a generally U-shaped configuration, and includes a transversely-extending cross member 114 near the foot end 44 and longitudinally-extending side members 116, 118 that extend away from the ends of the foot end cross member 114 toward the head end 42 of the stretcher 30. A pair of transversely spaced-apart rearwardly-extending flanges 120 extend from the foot end cross member 114 of the back frame 82, and couple to respective transversely spaced-apart forwardly-extending flanges 122 appended to the head end cross member 102 of the seat frame 80. Flanges 120 are coupled to flanges 122 by nut and bolt combinations 124 so that the back frame 82 can pivot relative to the seat frame 80 about the first pivot axis 100. The head end 42 of the back frame 82 extends about 20 inches (51 centimeters) from the head end 42 of the base 32 so that the surgeon can have enough clearance to approach the patient from either side and place his legs under the stretcher 30.

The back support 84 is mounted on the back frame 82 for translation along the longitudinal axis 50 in response to pivotal movement of the back frame 82 relative to the seat frame 80. For example, the back support 84 is extended toward the head end 42 when the back frame 82 is raised, and the back support 84 is retracted toward the foot end 44 when the back frame 82 is lowered. This allows a patient's head to remain located in the head rest 88 regardless of the position of the back frame 82, and the patient doesn't have to be repositioned when moved from a seated position to a flat position for eye surgery. Without correction for shear, the patient's head tends to extend past the stretcher 30 when the back frame 82 is raised and the patient's back tends to slide relative to the mattress 52. This happens because the position of the pivot point of the back frame 82 and the position of the hip joint of the patient supported on the mattress 52 on the upper deck 40 differ, and the back frame 82 and the upper body of the patient travel in different arcs when the back frame 82 is articulated.

The back support 84 is generally rectangular in configuration, and includes a transversely-extending cross member 132 near the head end 42, a transversely-extending cross member 134 near the foot end 44, and longitudinally-extending side members 136, 138 joining the head end and foot end cross members 132, 134. A longitudinally-extending central strut member 140 extends between the head end and foot end cross members 132, 134 to rigidify the structure. The inner walls of the longitudinally-extending side members 116, 118 of the back frame 82 are provided with guides 126, 128 which are slidably received in channels 146, 148 attached to the outer walls of the longitudinally-extending side members 136, 138 of the back support 84 to facilitate longitudinal shifting of the back support 84 relative to the back frame 82 in response to movement of the back frame 82.

The head frame 86 is coupled to the back support 84 for pivoting movement about a second transverse pivot axis 200. The head frame 86 has a harness-like configuration, and includes a pair of transversely spaced-apart longitudinally-extending side members 156, 158 (sometimes referred to herein as side arms) joined by head end and foot end cross members 152, 154 (sometimes referred to herein as cross rods). The side members 156, 158 are generally rectangular in configuration, and the cross members 152, 154 are generally circular in configuration.

In plan view, the head frame 86 generally echos the shape of the shoulders-to-neck portion of a patient. The head frame 86 is wider than the back support 84 in a patient's shoulder area, then narrows to the width of the head rest 88 in a patient's neck area, and finally extends forwardly alongside the head rest 88 in spaced-apart relation therewith near a patient's head area. In side view, the longitudinally-extending side arms 156, 158 each have a first portion 160 that arches upwardly and forwardly from the second pivot axis 200 in the shoulder area, a second portion 162 that angles inwardly toward the head rest 88 in the neck area, and a third portion 164 that extends forwardly parallel to side walls of the head rest 88 in the head area. The forwardly-extending portions 164 of the side arms 156, 158 of the head frame 86 are each provided with downwardly-extending flanges 166, 168 for pivotally supporting the head rest 88 for rotation about a third transverse pivot axis 300. Opposite ends of the head end cross member 152 of the head frame 86 are fixed to the inner walls of the downwardly-extending flanges 166, 168 as shown.

Figure 2:
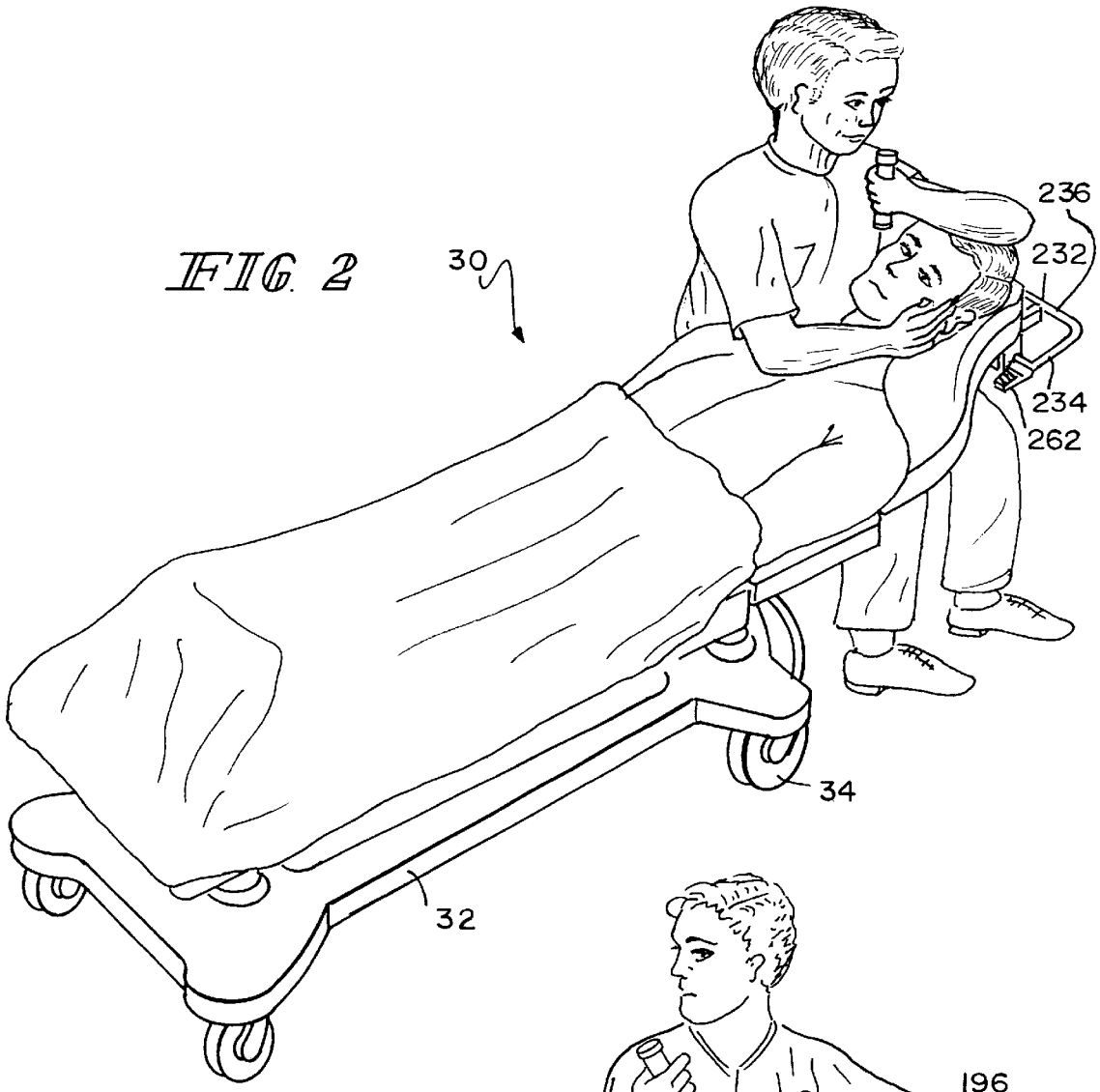
FIG. 2 is a perspective view of the stretcher of FIG. 1 with a patient placed thereon, and showing a surgeon seated in a chair next to the stretcher on one side thereof and the patient's head directly over the seated surgeon's lap.
Figure 3:
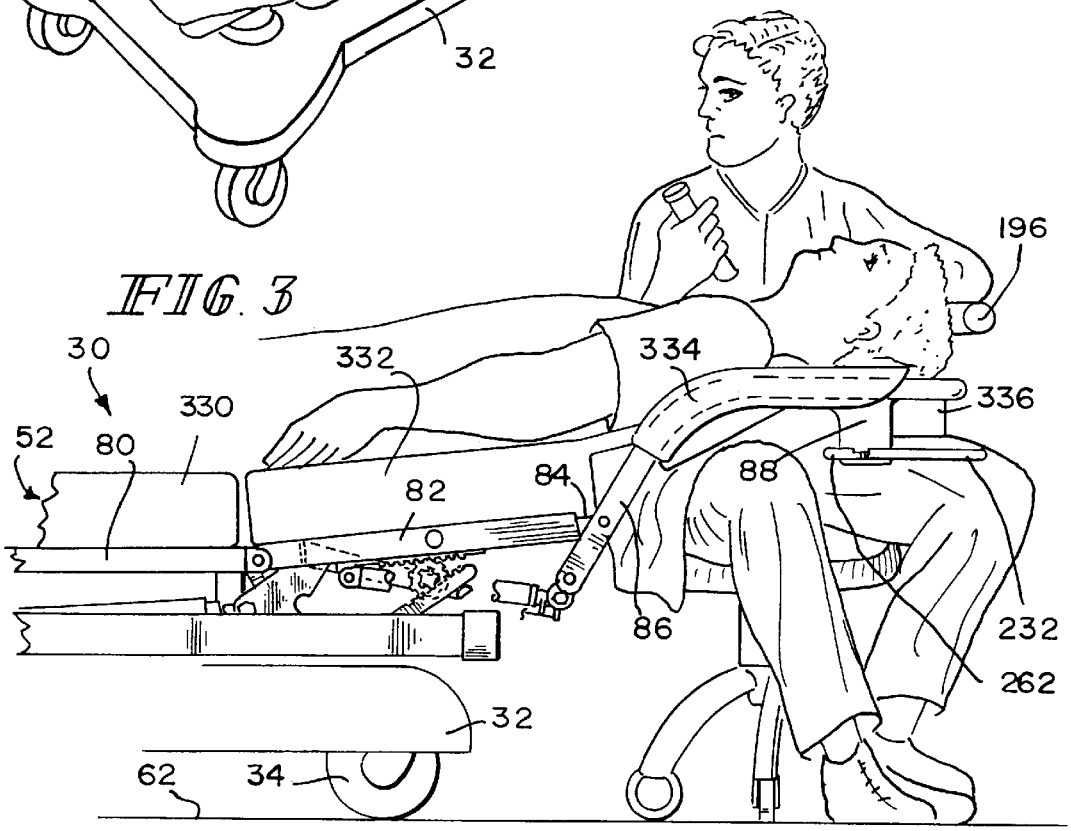
FIG. 3 is a side elevation view of the stretcher of FIG. 2 with a patient placed thereon, and showing the surgeon seated in the chair next to the stretcher and the patient's head directly over the seated surgeon's lap.
Figure 4:
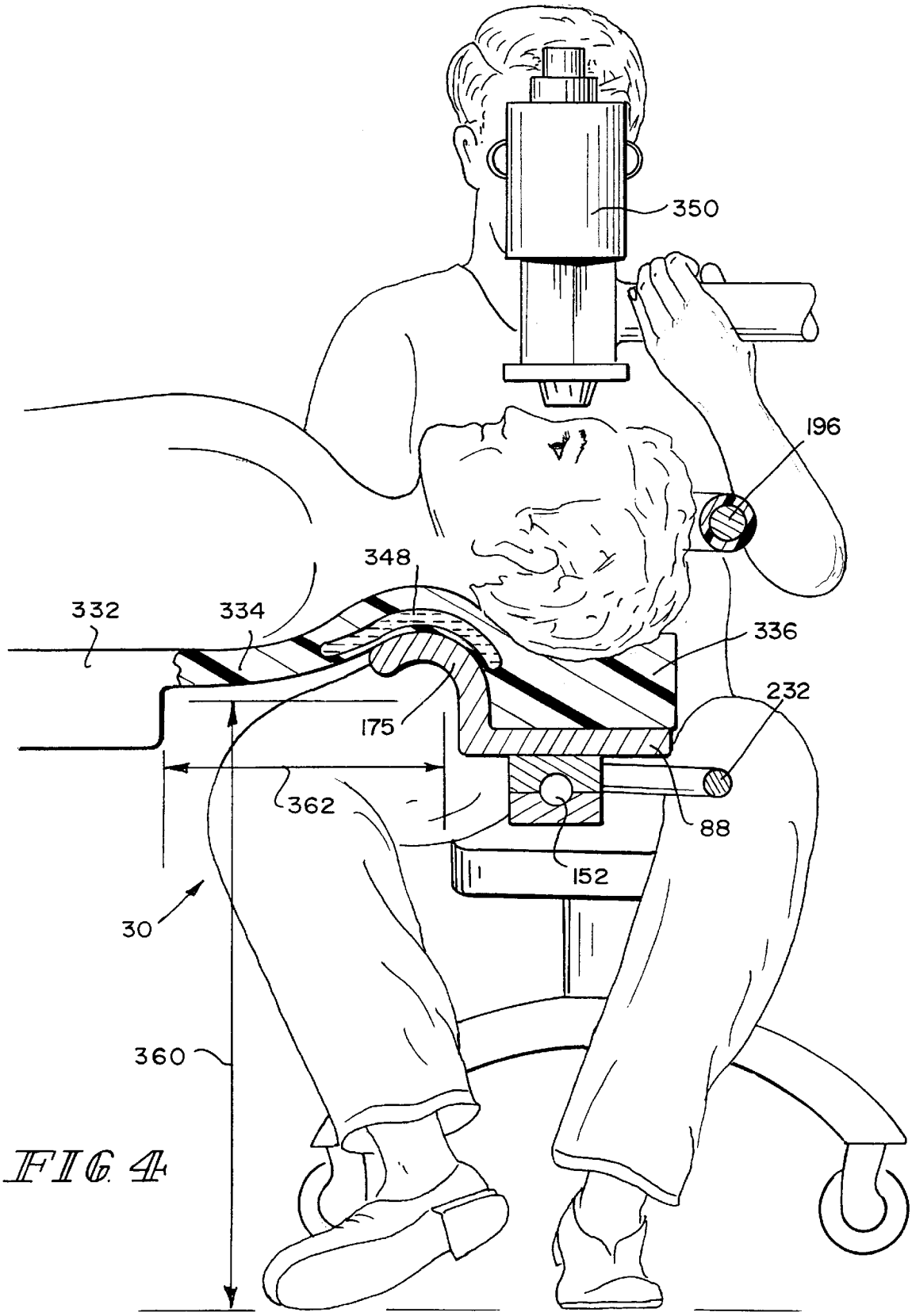
FIG. 4 is a partial side elevation view, partly in section, of the stretcher of FIG. 1 with a patient placed thereon, and showing the surgeon seated in the chair next to the stretcher, and showing the patient's head over the seated surgeon's lap with the patient's eye directly under a microscope in front of him, the upper deck being sufficiently lowered so that the surgeon's forearms can be close to parallel to the floor, and the patient's eye far enough away from the microscope to allow the surgeon to focus the microscope on the patient's eye.

The upwardly arching portions 160 of the longitudinally-extending side arms 156, 158 of the head frame 86 are pivotally coupled to the head end cross member 132 of the back support 84 by a pair of pivot pins 170. The head end cross member 132 of the back support 84 is made wider than the rest of the back support 84 so that a patient's shoulders are comfortably supported by a wider portion of the head frame 86. The back support 84 extends only to a patient's shoulder blades. The head frame 86 supports a patient's shoulders. The head frame 86 defines a generally horizontal, upwardly facing support surface 90 (FIGS. 8, 9) that is raised relative to a generally horizontal, upwardly facing support surface 92 (FIGS. 8, 9) defined by the seat and back frames 80, 82. As shown in FIGS. 2–4, the upwardly and forwardly arching side arms 156, 158 of the head frame 86 create unobstructed space for a surgeon's legs under a patient's shoulders, neck and head.

Figure 10:
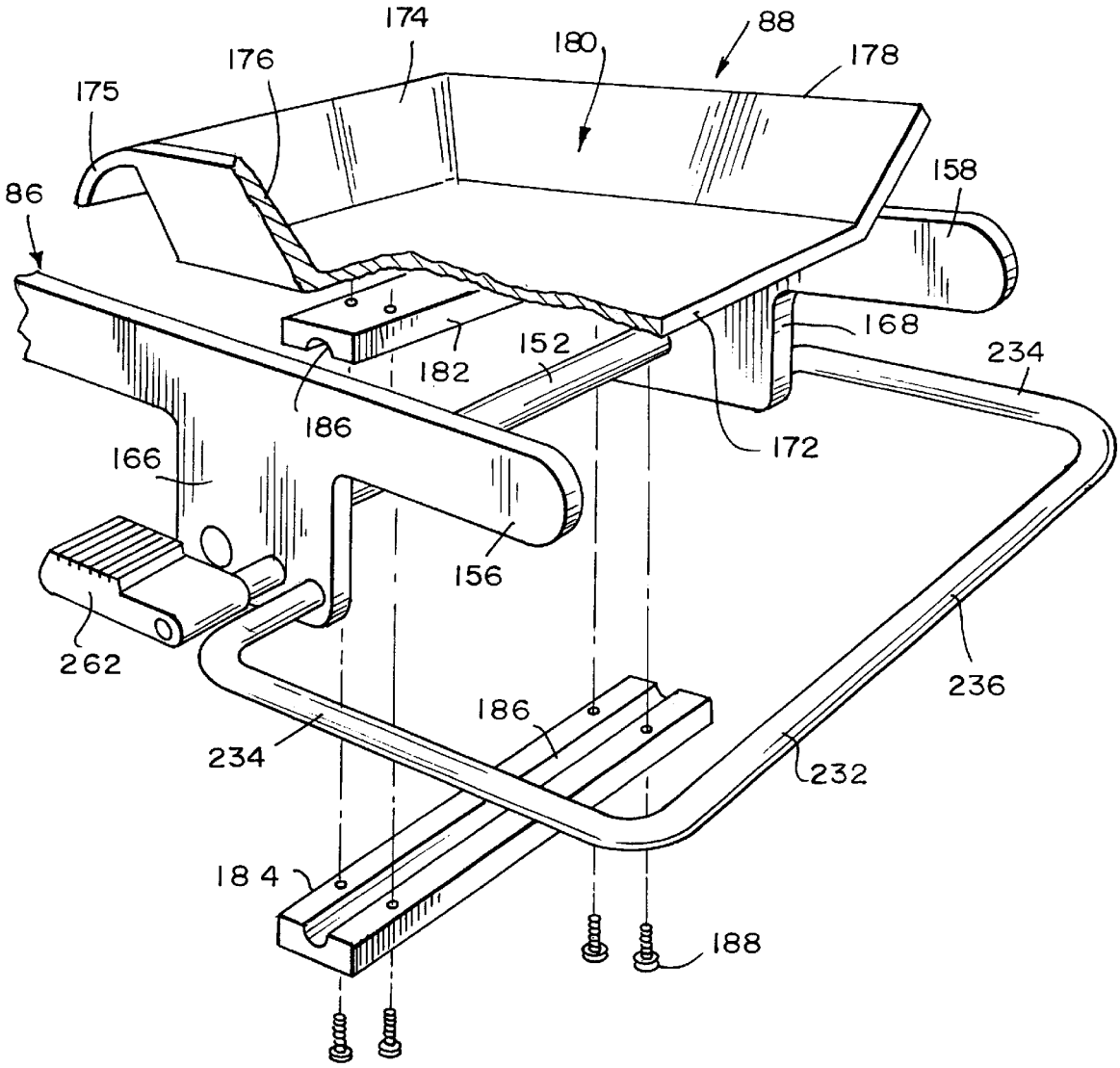
FIG. 10 is an exploded perspective view, partly broken away, showing the head rest configured to be pivotally mounted to the head frame, the head rest having walls forming a head cushion-receiving space, a release button that can be pressed to unlock the head frame for pivoting movement relative to the back support, a wire grip handle coupled to the head frame that can be grasped to move the head frame when unlocked.
Figure 11:
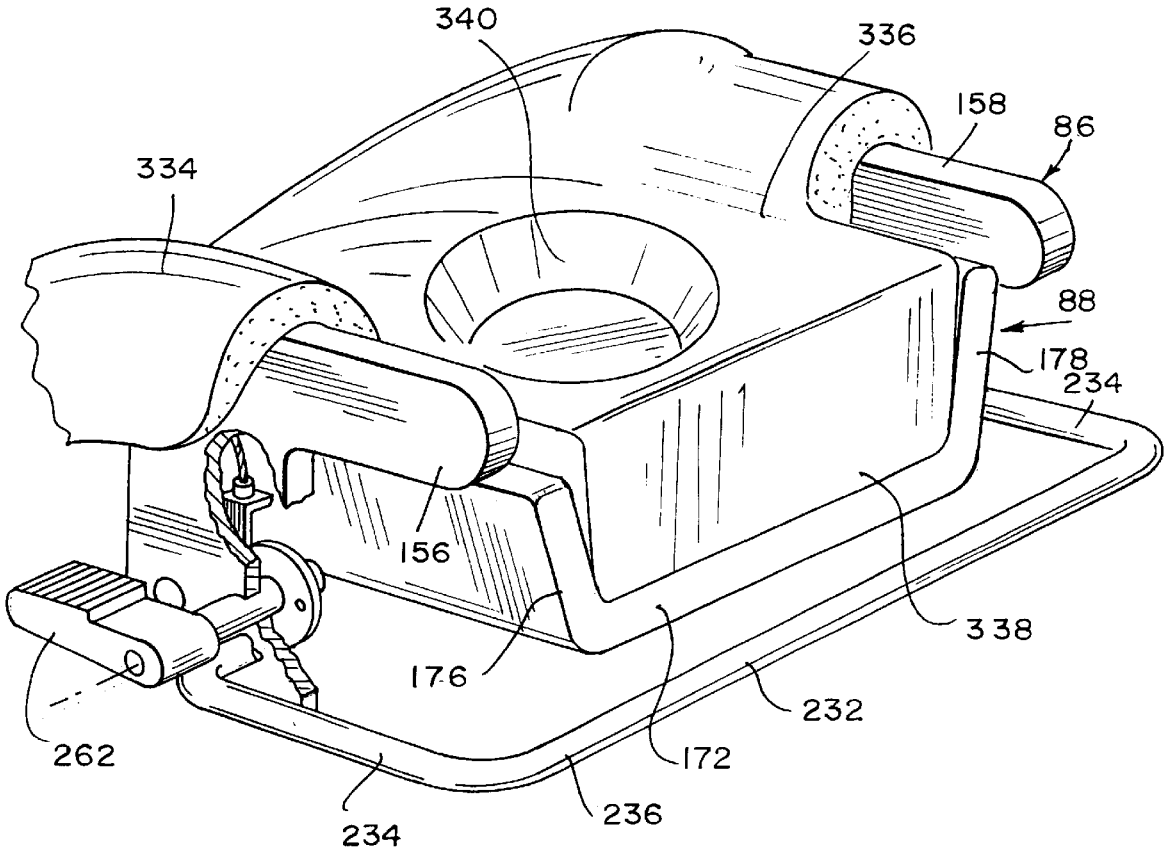
FIG. 11 is a perspective view, partly broken away, showing the head rest pivotally mounted to the head frame, the head cushion received in the head cushion-receiving space, and the head cushion having a cavity for supporting a patient's head.

As previously described, the head rest 88 is coupled to the head frame 86 for rotation about the third pivot axis 300 (FIG. 5). As best shown in FIGS. 10 and 11, the head rest 88 includes a bottom plate 172, a transversely-extending foot end plate 174 angling upwardly and rearwardly from the rear edge of the bottom plate 172, and a pair of transversely spaced-apart longitudinally-extending side plates 176, 178 angling upwardly and outwardly from the respective side edges of the bottom plate 172 to define a flared head cushion-receiving space 180. Although the bottom plate 172, the foot end plate 174 and the side plates 176, 178 of the head rest 88 are shown as being integrally formed, it is within the scope of the invention as presently perceived for some or all of these components to be separate pieces that are fastened together. The upper portion of the foot end plate 174 is formed to extend rearwardly and downwardly to provide a rounded ledge 175 for supporting a patient's neck.

The head rest 88 is pivotally coupled to the generally circular cross member 152 of the head frame 86 by top and bottom rails 182, 184 for rotation about the third pivot axis 300. The bottom wall of the top rail 182 and the top wall of the bottom rail 184 are each formed to include a generally semicircular channel 186 for receiving the head end cross member 152. When assembled, the top and bottom channels 186 of the rails 182, 184 form a generally circular cross-section that is slightly smaller than the generally circular cross-section of the cross member 152 of the head frame 86 to provide tight frictional engagement. The top and bottom rails 182, 184 are secured to the underside of the bottom plate 172 of the head rest 88 by screws 188 with the cross member 152 of the head frame 86 clamped therebetween. The frictional engagement between the cross member 152 of the head frame 86 and the inner walls of the channels 186 in the rails 182, 184 securely clamp the head rest 88.

The forwardly-extending portions 164 of the side arms 156, 158 of the head frame 86 are generally rectangular in configuration, and are formed to extend past the downwardly-extending flanges 166, 168. The forwardly-extending portions 164 are each configured to support a temporal wrist rest assembly 190 shown in FIG. 5. The wrist rest assembly 190 includes a guide block 192, a vertical telescopic post 194 and a wrist rest 196 for supporting a surgeon's wrist. The guide block 192 includes a longitudinally-extending channel 198 for slidably receiving the forwardly-extending portions 164 of the side arms 156, 158 of the head frame 86. The telescopic vertical post 194 allows the surgeon to adjust the height of the wrist rest 196.

As previously described, the back frame 82 can pivot about the first pivot axis 100 between a horizontal position, an inclined position, and intermediate positions therebetween. As shown in FIG. 5, the stretcher 30 includes a pair of gas springs 206, 208 on opposite sides 46, 48 thereof that are lockable so that the back frame 82 is prevented from pivoting about the first pivot axis 100 relative to the seat frame 80. The gas springs 206, 208 are releasable so that the back frame 82 can pivot about the first pivot axis 100 relative to the seat frame 80.

Figure 8:
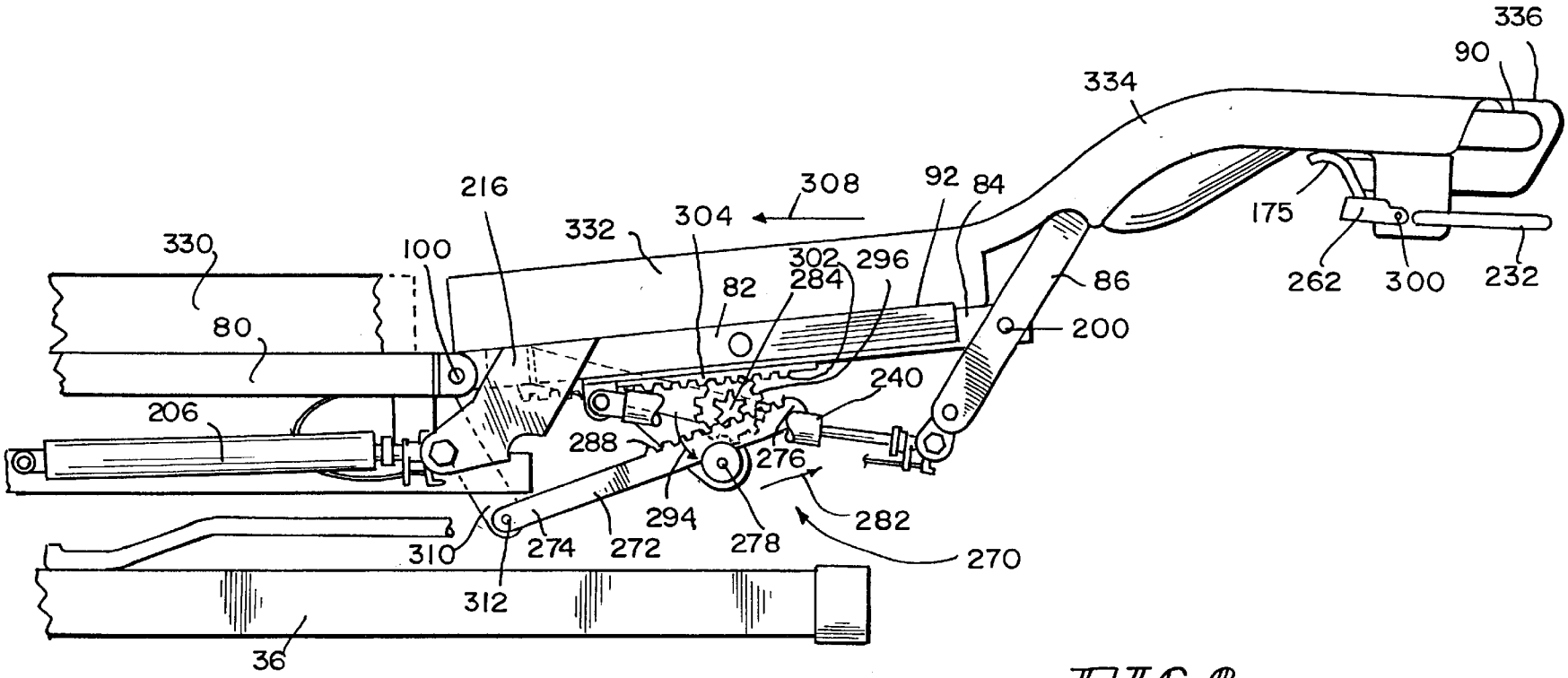
FIG. 8 is a side elevation view of the stretcher of FIG. 1 showing the back frame locked in a generally horizontal position by two gas spring connecting the back frame to the seat frame, the back support translatably mounted on the back frame, the head frame pivotally mounted to the back support, the head frame locked in a generally horizontal position by a gas spring connecting the head frame to the back support, the gas springs being actuatable to unlock the back frame for pivoting movement relative to the seat frame and the head frame for pivoting movement relative to the back support, and further showing the mattress seat portion supported on the seat frame, the mattress back portion supported on the back support, mattress shoulder portion supported on the head frame and the mattress head portion supported on the head rest.
Figure 9:
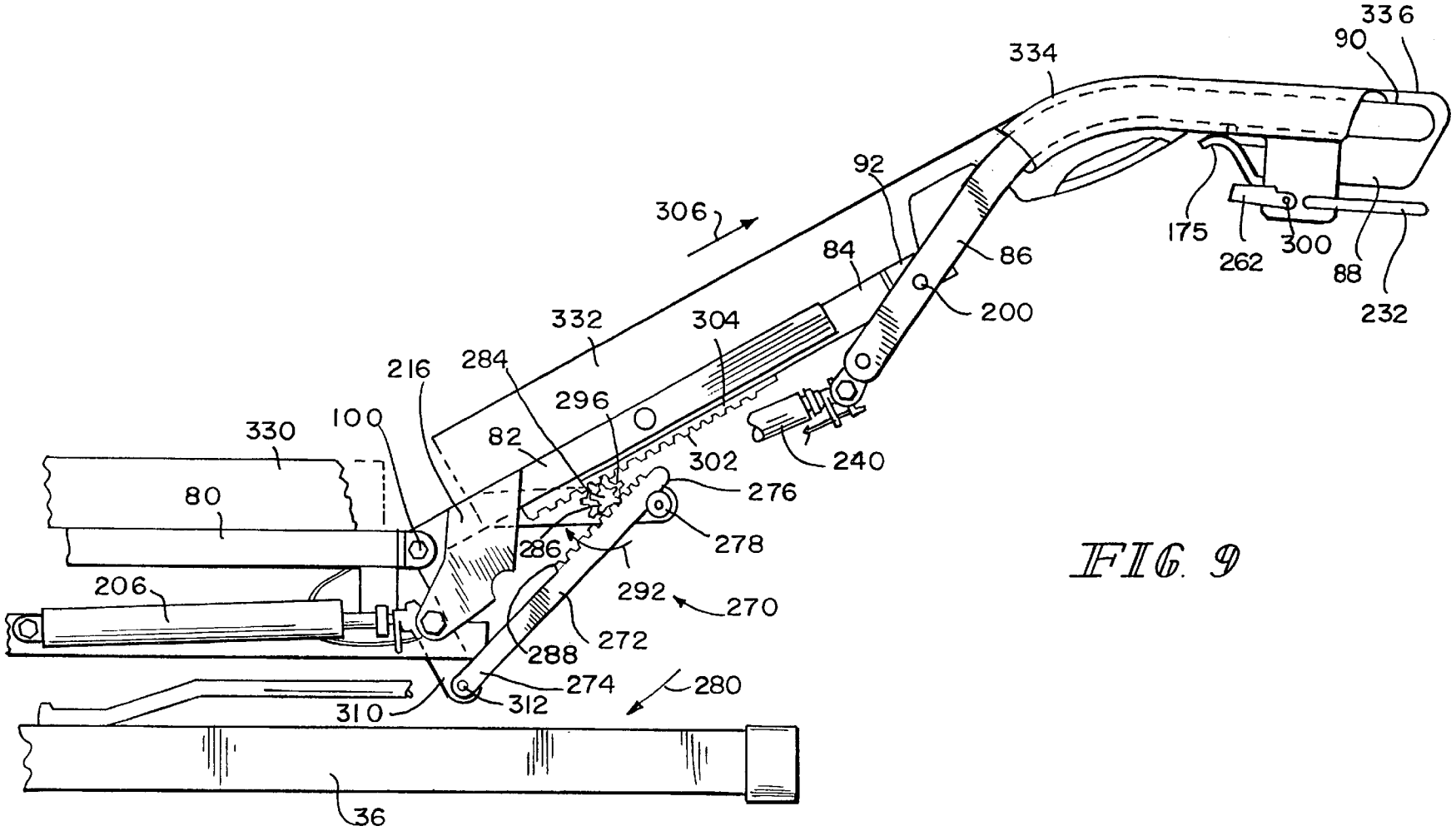
FIG. 9 is a view similar to FIG. 8 showing the back frame lifted relative to the seat frame, and further showing the back support extended toward the head end in response to lifting of the back frame, and the back, shoulder and head portions of the mattress separated from the seat portion of the mattress.

The two gas springs 206, 208 are each pivotally coupled between the back frame 82 and the seat frame 80. The gas spring 206 near the first side 46 has a head end 212 pivotally coupled to a pair of spaced-apart flanges 216 by a pivot pin 220 as shown in FIGS. 5, 8, 9. The flanges 216 are appended to the foot end 44 of the longitudinally-extending member 116 of the back frame 82, and extend downwardly and rearwardly therefrom as shown. A foot end 214 of the gas spring 206 includes a pair of rearwardly-extending spaced-apart flanges 226. The flanges 226 are pivotally coupled to the plate member 96 near the foot end 44 of the longitudinally-extending member 106 of the seat frame 80 by a pivot pin 220. Likewise, the gas spring 208 near the second side 48 has a head end 222 pivotally coupled to a pair of spaced-apart flanges 218 by a pivot pin 220. The flanges 218 are appended to the foot end 44 of the longitudinally-extending member 118 of the back frame 82, and extend downwardly and rearwardly therefrom as shown. A foot end 224 of the gas spring 208 includes a pair of rearwardly-extending spaced-apart flanges 228. The flanges 228 are pivotally coupled to the plate member 98 near the foot end 44 of the longitudinally-extending member 108 of the seat frame 80 by a pivot pin 220.

As shown in FIG. 5, the stretcher 30 includes a release lever 238 located near the shoulder area of a patient that can be actuated from a locking position to an unlocking position to release the two gas springs 206, 208 to free the back frame 82 to pivot about the first pivot axis 100. Releasing the release lever 238, on the other hand, locks the gas springs 206, 208 to prevent the back frame 82 from pivoting. The release lever 238 is sufficiently close to the side arm 158 of the head frame 86 to allow the surgeon to simultaneously grasp the side arm 158 and the release lever 238, and squeeze the release lever 238 to unlock the gas springs 206, 208 and free the back frame 82 to pivot.

As previously described, the head frame 86 can pivot about the second pivot axis 200 (FIG. 5) between a lowered position, a raised position, and intermediate positions therebetween. The stretcher 30 includes a gas spring 240 that is lockable so that the head frame 86 is prevented from pivoting about the second pivot axis 200 relative to the back support 84, and releasable so that head frame 86 can pivot about the second pivot axis 200 relative to back support 84. The gas spring 240 has a head end 242 pivotally coupled to a flange 252 by a pivot pin 250 as shown in FIGS. 5, 8, 9. The flange 252 is appended to the foot end cross bar 154 of the head frame 86, and extends downwardly and rearwardly therefrom as shown. A foot end 244 of the gas spring 240 includes a pair of rearwardly-extending spaced-apart flanges 254. The flanges 254 are pivotally coupled to a flange 256 appended to the foot end cross member 134 of the back support 84 by a pivot pin 250. As shown in FIG. 5, the stretcher 30 includes a release button 262 located near the head area of a patient that can be actuated from a locking position to an unlocking position to release the gas spring 240 to free the head frame 86 to pivot about the second pivot axis 200. Releasing the release button 262, on the other hand, locks the gas spring 240 to prevent the head frame 86 from pivoting about the second pivot axis 200.

A wire grip handle 232 is coupled to head frame 86 as shown, for example, in FIGS. 1–5 and 8–11. The wire grip handle 232 includes a pair of side handle portions 234 (FIGS. 10 and 11) that extend longitudinally alongside each of the sides 46, 48 of the head rest 88 in spaced-apart relation therewith. Upon releasing the gas spring 240, the side handle portions 234 can be grasped to guide the movement of head frame 86 as the position of head frame 86 is manually adjusted by the surgeon. The grip handle 232 also includes an end handle portion 236 (FIGS. 10 and 11) connecting the side handle portions 234 near the head end 42 of the stretcher 30. The end handle portion 236 can be grasped by the caregiver to help guide the movement of the stretcher 30 along the floor 62.

In preferred embodiments, the gas springs 206, 208, 240 are employed for releasably locking the back frame 82 relative to the seat frame 80, and for releasably locking the head frame 86 relative to the back support 84. It is, however, within the scope of the invention as presently perceived to use any locking device that can extend and retract, and that can be locked at any location to prevent movement of the device. Thus, the term "gas spring" as used in this specification and in the claims is for convenience, and includes any such locking device—for example, a spring clutch, a hydraulic cylinder, a pneumatic cylinder, etc.

As previously described, the stretcher 30 includes a drive assembly 270 for extending the back support 84 when the back frame 82 is raised, and for retracting the back support 84 when the back frame 82 is lowered to compensate for shear. Referring to FIGS. 6–9, the drive assembly 270 includes a first rack 272 having a first portion 274 pivotally coupled to the seat frame 80 and a second portion 276 supported on a pulley 278 coupled to the back frame 82 such that the first rack 272 shifts longitudinally relative to the back frame 82 when the back frame 82 is pivoted relative to the seat frame 80. For example, the first rack 272 moves toward the foot end 44 in direction 280 relative to the back frame 82 when the back frame 82 is raised as shown in FIG. 9, and the first rack 272 moves toward the head end 42 in direction 282 when the back frame 82 is lowered as shown in FIG. 8. This condition happens because the position of the pivot point 100 of the back frame 82 and the position of the pivot point 312 of the first rack 272 differ, and the back frame 82 and the first rack 272 travel in different arcs when the back frame 82 is articulated.

The drive assembly 270 further includes a small pinion 284 having external teeth 286. The small pinion 284 is rotatably coupled to the back frame 82. The first rack 272 has teeth 288 on an upper wall 290 thereof which engage the teeth 286 on the underside of the small pinion 284 such that the small pinion 284 rotates in clockwise direction 292 when the back frame 82 is raised, and such that the small pinion 284 rotates in anticlockwise direction 294 when the back frame 82 is lowered. The small pinion 284 is rotatably coupled to a large pinion 296 having external teeth 298. The teeth 298 on the topside of the large pinion 296, in turn, engage teeth 300 on a lower wall 302 of a second rack 304 attached to the underside of the back support 84 for motion therewith.

Thus, when the back frame 82 is raised as shown in FIG. 9, the first rack 272 moves toward the foot end 44 in the direction 280, the small pinion 284 in engagement with the first rack 272 and the large pinion 296 both rotate in the clockwise direction 292, the second rack 304 in engagement with the large pinion 296 moves toward the head end 42 in direction 306, and the back support 84 attached to the second rack 304 also moves toward the head end 42 in the direction 306. On the other hand, when the back frame 82 is lowered as shown in FIG. 8, the first rack 272 moves toward the head end 42 in the direction 282, the small pinion 284 in engagement with the first rack 272 and the large pinion 296 both rotate in the anticlockwise direction 294, the second rack 304 in engagement with the large pinion 296 moves toward the foot end 44 in direction 308, and the back support 84 attached to the second rack 304 also moves toward the foot end 44 in the direction 308. The total extension of the back support 84 in response to lifting and lowering of the back frame 82 is about 4–5 inches (10–13 centimeters). Of course, the diameters of the pinions 284, 296 can be changed to obtain different extension of the back support 84 in response to the movement of the back frame 82.

The construction of the drive assembly 270 will now be explained with reference to FIGS. 5–9. The first portion 274 of the first rack 272 is pivotally coupled to a flange 310 by a pivot pin 312. The flange 310 extends forwardly and downwardly from the head end cross member 102 of the seat frame 80 as shown. The pulley 278 and the small pinion 284 are rotatably coupled to a flange 314 that extends forwardly and downwardly from the foot end cross member 114 of the back frame 82. The lower wall 316 of the first rack 272 is supported by the pulley 278, and the teeth 288 on the upper wall 290 of the first rack 272 engage the small pinion 284. The small pinion 284 and the large pinion 296 are both rotatably mounted to the flange 314 on a common shaft on the opposite sides of the flange 314. The second rack 304 is mounted to the underside of the central strut member 140 of the back support 84.

As previously described, the mattress 52 is supported on the upper deck 40 of the stretcher 30. The mattress 52 includes a mattress seat portion 330 supported on the seat frame 80, the mattress back portion 332 supported on the back support 84, a mattress shoulder portion 334 (sometimes referred to herein as sling portion) supported on the head frame 86, and a mattress head portion 336 (sometimes referred to herein as head cushion) supported on the head rest 88 as shown in FIG. 5. Panels 328 (FIGS. 6, 7) are mounted on the seat frame 80 and the back support 84 for supporting the mattress seat and back portions 330, 332. The mattress seat portion 330 supports a patient's seat and legs. The mattress back portion 332 supports a patient's back. The mattress sling portion 334 supports a patient's shoulders. The mattress sling portion 334 includes an optional gel insert 348 (see FIG. 4) for supporting the neck area of the patient. The mattress head portion 336 includes a thicker foam section 338 and a cutout 340 with an optional gel insert (not shown) therein to locate and pad the crown of a patient's head.

Figure 12:
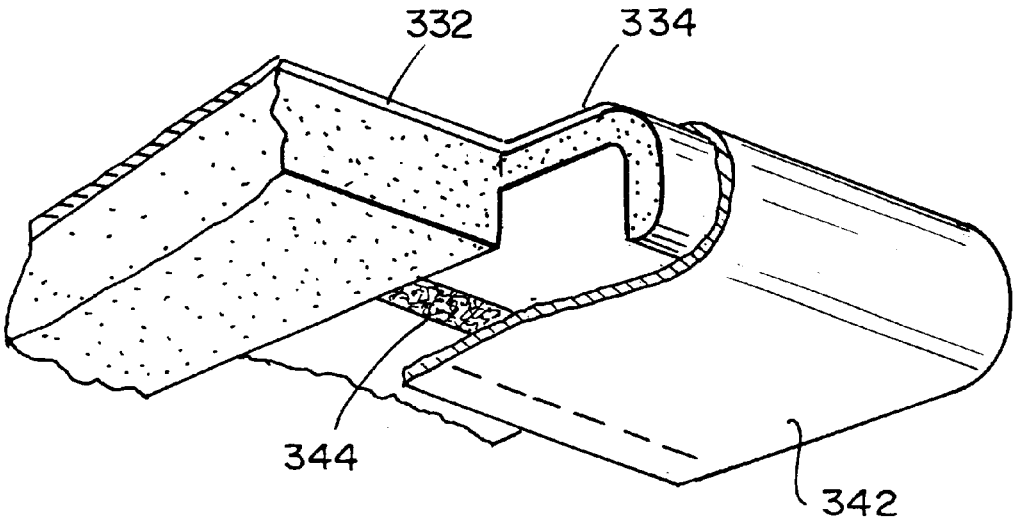
FIG. 12 is an enlarged perspective view, partly broken away, showing the mattress shoulder portion having a flap on each side thereof secured to the underside of the mattress shoulder portion to position the shoulder portion over the side arms of the head frame.
Figure 13:
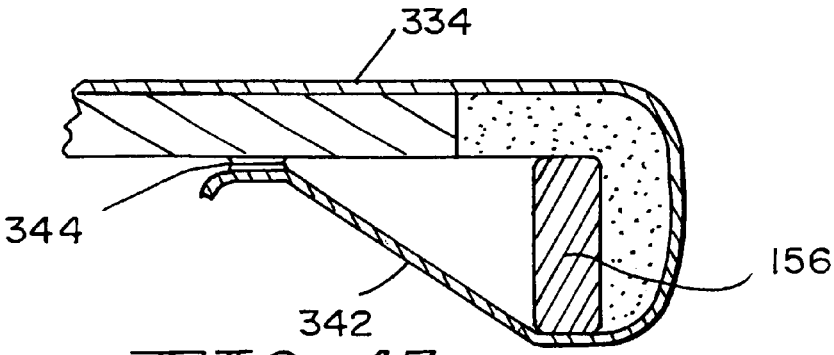
FIG. 13 is a sectional view showing the flaps secured to the underside of the mattress shoulder portion by Velcro pads to form a sleeve on each side thereof to enclose a respective one of the side arms of the head frame to allow the head frame to pivot relative to the back frame without interference from the mattress shoulder portion.
Figure 14:
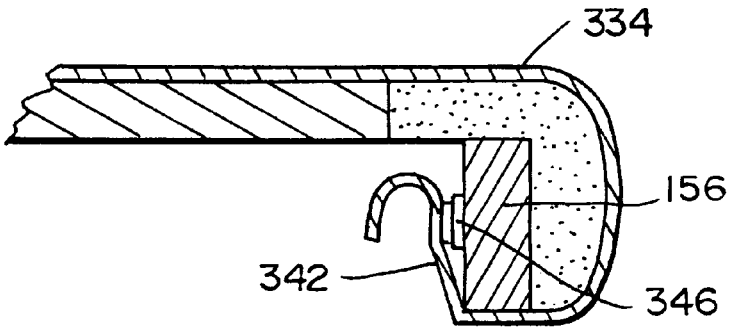
FIG. 14 is a sectional view showing the flaps of the mattress shoulder portion secured to the inside wall of the side arms of the head frame by snap buttons.

As shown in FIGS. 12–14, the mattress sling portion 334 includes flaps 342 on the underside thereof, one on each side 46, 48, to position the sling portion 334 over the side arms 156, 158 of the head frame 86. As shown in FIG. 13, a hook and loop device 344, such as a fastener sold under the trademark "Velcro", may be used for releasably securing the flaps 342 to the underside of the mattress sling portion 334 to form sleeves enclosing the side arms 156, 158 to allow the mattress sling portion 334 to slide with respect to the side arms 156, 158 when the position of the head frame 86 is adjusted by the surgeon or caregiver. Such a fastener, and several varieties are contemplated without departing from the invention, permits the sling portion 334 to be readily releasably secured in its mounted position. For example, as shown in FIG. 14, snap buttons 346 may be used, instead of Velcro pads 344, for securing the flaps 342 of the sling portion 334 to the inside walls of the side arms 156, 158 of the head frame 86.

The head frame 86 defines a generally horizontal, upwardly facing support surface 90 that is raised relative to a generally horizontal, upwardly facing support surface 92 defined by the seat and back frames 80, 82 as shown in FIGS. 8, 9. As shown in FIGS. 5 and 12–14, the thickness of the mattress shoulder portion 334 is reduced relative to the thickness of the mattress seat and back portions 330, 332 so that upwardly-facing top surfaces of the mattress seat, back and shoulder portions 330, 332, 334 are generally coplanar, and define the upwardly-facing patient-support surface 54 of the mattress 52. Illustratively, the mattress seat and back portions 330, 332 are each about 3–4 inches thick (8–10 centimeters). The mattress shoulder portion 334 is about 1 inch thick (2–3 centimeters).

The stretcher 30 is well suited for eye surgery, and particularly, for outpatient eye surgery. The stretcher 30 can be used to transport a patient from the pre-op waiting area to an operating room where surgery is to be performed on the patient. During transport, the back frame 82 can be placed in a desired position depending upon the preference of the caregiver or the patient. For example, if the patient is unconscious, the back section 82 can be moved to a horizontal position in which the patient is supported in a lying-down position. Alternatively, if the patient is conscious and capable of sitting up, the back frame 82 can be moved to an inclined position in which the back frame 82 is angled at about seventy degrees (70°) relative to the seat frame 80, thereby placing the patient in a sitting-up position. In addition, the back frame 82 can be moved to any one of the intermediate positions between the horizontal and inclined positions, if desired.

During transport of the patient to the operating room, the foot pedals 66 can be used to move the brake-steer shaft 70 to the steering position to lower the center wheel to engage the floor 62. The engagement of the center wheel with the floor 62 assists in steering the stretcher 30 by providing a frictional contact area with the floor 62 about which the stretcher 30 can be easily turned. After the stretcher 30 reaches the desired location in the operating room, the foot pedals 66 can be used to move the brake-steer shaft 70 to the braking position so that the casters 34 are prevented from rotating or swivelling, thereby preventing the stretcher 30 from moving along the floor 62.

Prior to surgery, the back frame 82 can be moved to the horizontal position so that IV fluids and anesthesia can be administered to the patient during surgery. The surgeon sits on one side of the stretcher 30 with the patient's head directly over the seated surgeon's lap as shown in FIGS. 2–4. The upwardly and forwardly arching side arms 156, 158 of the head frame 86 create unobstructed space for a surgeon's legs. Typically, the surgeon positions himself where the patient's eye is directly under a microscope 350 in front of him. The surgeon has ready access to the controls for the microscope and other equipment. For example, the surgeon can depress the release button 262 to unlock the gas spring 240 to free the head frame 86 and use the wire grip handle 232 to move the head frame 86 to a desired position, or unlock the casters 34 and use the wire grip handle 232 to position the stretcher 30 along the floor 62, or depress the release lever 238 to unlock the gas springs 206, 208 to free the back frame 82 to pivot relative to the seat frame 80 and then adjust the position of the back frame 82. The patient is lowered using the foot pedals 66 so that the surgeon's forearms are close to parallel to the floor 62, and the patient's eye is far enough away from the microscope to allow focusing of the microscope on the eye. After surgery, the foot pedals 66 can be used to move the brake-steer shaft 70 out of the braking position and into the steering position, and the stretcher 30 can then be used to transport the patient to a post-op area where the patient can recover from surgery.

Although the illustrative stretcher has been described in detail with reference to certain preferred embodiments, variations and modifications exist within the scope and spirit of the invention as described and as defined in the following claims.

What is claimed is:

1. A patient support apparatus comprising:

a first section adapted to support a first portion of a patient, a second section that is adapted to support a second portion of the patient and that is pivotably movable relative to the first section about a first pivot axis, a third section that is adapted to support a third portion of the patient and that is pivotably movable relative to the second section about a second pivot axis that is parallel with the first pivot axis, a first locking mechanism that, when locked, prevents the second section from pivoting relative to the first section, a first lever that is movable to unlock the first locking mechanism to allow the second section to pivot relative to the first section, a second locking mechanism that, when locked, prevents the third section from pivoting relative to the second section, a second lever that is movable to unlock the second locking mechanism to allow the third section to pivot relative to the second section, wherein the first and second levers are both coupled to the third section.

2. The patient support apparatus of claim 1, wherein the first and second levers are pivotable relative to the third section.

3. The patient support apparatus of claim 1, wherein at least a majority of the second section is situated between the first and third sections.

4. The patient support apparatus of claim 1, wherein the first, second, and third sections comprise respective frames and mattress portions.

5. The patient support apparatus of claim 4, wherein the mattress portion associated with the second section is integral with the mattress portion associated with the third section to define a common mattress pad and the mattress portion associated with the first section is separate from the common mattress pad.

6. The patient support apparatus of claim 5, wherein a part of the common mattress pad is adapted to support a neck of the patient.

7. The patient support apparatus of claim 4, wherein a part of the mattress portions is capable of supporting a neck of the patient.

8. The patient support apparatus of claim 4, wherein at least one of the first and second levers is grippable simultaneously with the frame of the third section.

9. The patient support apparatus of claim 8, wherein the first lever has a distal end that moves closer to the frame of the third section when the first lever is moved to unlock the first locking mechanism.

10. A patient support apparatus having a head end and a foot end, the patient support apparatus comprising:

a base, a deck supported above the base and being configured to support a patient, the deck having a first section, a second section pivotable relative to the first section, and a third section that is near the head end and that is pivotable relative to the second section, a first locking mechanism having a locked position and a released position, the second section being locked relative to the first section when the first locking mechanism is in the locked position, the second section being pivotable relative to the first section when the first locking mechanism is in the released position, a first lever coupled to the third section and movable between a first position and a second position, the first locking mechanism being in the locked position when the first lever is in the first position, the first locking mechanism being in the released position when the first lever is in the second position, a second locking mechanism having a locked position and a released position, the third section being locked relative to the second section when the second locking mechanism is in the locked position, the third section being pivotable relative to the second section when the section locking mechanism is in the released position, and a second lever coupled to the third section and movable between a first position and a second position, the second locking mechanism being in the locked position when the second lever is in the first position, the second locking mechanism being in the released position when the second lever is in the second position.

11. The patient support apparatus of claim 10, wherein the first and second levers are pivotable relative to the third section.

12. The patient support apparatus of claim 10, wherein at least a majority of the second section is situated between the first and third sections.

13. The patient support apparatus of claim 10, wherein the first, second, and third sections comprise respective frames and mattress portions.

14. The patient support apparatus of claim 13, wherein the mattress portion associated with the second section is integral with the mattress portion associated with the third section to define a common mattress pad and the mattress portion associated with the first section is separate from the common mattress pad.

15. The patient support apparatus of claim 14, wherein a part of the common mattress pad is adapted to support a neck of the patient.

16. The patient support apparatus of claim 13, wherein a part of the mattress portions is capable of supporting a neck of the patient.

17. The patient support apparatus of claim 13, wherein at least one of the first and second levers is grippable simultaneously with the frame of the third section.

18. The patient support apparatus of claim 17, wherein the first lever has a distal end that moves closer to the frame of the third section when the first lever is moved to unlock the first locking mechanism.

19. The patient support apparatus of claim 10, wherein the second section is pivotable about a first pivot axis relative to the first section, the third section is pivotable about a second pivot axis relative to the second section, and the first axis is parallel with the second axis.

20. A patient support apparatus comprising:

a base, a patient support deck supported above the base, the patient support deck comprising a first section having a first frame and a first mattress portion, a second section having a second frame and a second mattress portion, and a third section having a third frame and a third mattress portion, the second section being pivotable relative to the first section, the third section being pivotable relative to the second section, a first locking mechanism that, when locked, prevents the second section from pivoting relative to the first section, a second locking mechanism that, when locked, prevents the third section from pivoting relative to the second section about the second pivot axis, a first lever associated with the first locking mechanism and movable to unlock the first locking mechanism to allow the second section to pivot relative to the first section, and a second lever associated with the second locking mechanism and movable to unlock the second locking mechanism to allow the third section to pivot relative to the second section, the first and second levers being supported for movement relative to the third frame and situated close enough to the third frame so as to be grippable simultaneously with the third frame.

21. The patient support apparatus of claim 20, wherein the first and second levers are pivotable relative to the third frame.

22. The patient support apparatus of claim 20, wherein at least a majority of the second section is situated between the first and third sections.

23. The patient support apparatus of claim 20, wherein the third section further comprises a plate coupled to the third frame and underlying a part of the third mattress portion that supports a patient's head.

24. The patient support apparatus of claim 20, wherein the mattress portion associated with the second section is integral with the mattress portion associated with the third section to define a common mattress pad and the mattress portion associated with the first section is separate from the common mattress pad.

25. The patient support apparatus of claim 24, wherein a part of the common mattress pad is adapted to support a patient's neck.

26. The patient support apparatus of claim 20, wherein the first lever has a distal end that moves closer to the third frame when the first lever is moved to unlock the first locking mechanism.

27. The patient support apparatus of claim 20, wherein the second section is pivotable about a first pivot axis relative to the first section, the third section is pivotable about a second pivot axis relative to the second section, and the first axis is parallel with the second axis.

28. A patient support apparatus having a head end and foot end, the patient support apparatus comprising:

a base, a deck supported above the base, the deck including a first section, a second section adjustably movable relative to the first section, a third section near the head end adjustably movable relative to the second section, a first locking mechanism configured to lock the second section relative to the first section, a first lever near the head end, the first lever being selectively movable to unlock the first locking mechanism, a second locking mechanism configured to lock the third section relative to the second section, and a second lever near the head end, the second lever being selectively movable to unlock the second locking mechanism, the first and second levers being coupled to a common one of the first, second and third sections.

29. The patient support apparatus of claim 10, wherein the first and second levers are pivotable relative to the third section.

30. The patient support apparatus of claim 10, wherein at least a majority of the second section is situated between the first and third sections.

31. The patient support apparatus of claim 10, wherein the first, second, and third sections comprise respective frames and mattress portions.

32. The patient support apparatus of claim 31, wherein a part of the mattress portions is capable of supporting a neck of the patient.

33. The patient support apparatus of claim 31, wherein at least one of the first and second levers is grippable simultaneously with the frame of the third section.

34. The patient support apparatus of claim 31, wherein the first lever has a distal end that moves closer to the frame of the third section when the first lever is moved to unlock the first locking mechanism.

35. The patient support apparatus of claim 28, wherein the second section is pivotable about a first pivot axis relative to the first section, the third section is pivotable about a second pivot axis relative to the second section, and the first axis is parallel with the second axis.

36. The patient support apparatus of claim 28, wherein the first section comprises a seat section, the second section comprises a back section, and the third section comprises a head section.

37. The patient support apparatus of claim 36, wherein the seat section comprises a seat frame and a mattress seat portion, the back section comprises a back frame and a mattress back portion, and the head section comprises a head frame and a mattress head portion.

38. The patient support apparatus of claim 37, wherein the mattress back portion is integral with the mattress head portion to define a common mattress pad and the mattress seat portion is separate from the common mattress pad.

39. A patient support apparatus having a head end and foot end, the patient support apparatus comprising:

a base, a deck supported above the base, the deck including a first section, a second section adjustably movable relative to the first section, a third section near the head end adjustably movable relative to the second section, a first locking mechanism configured to lock the second section relative to the first section, a first lever near the head end, the first lever being selectively movable to unlock the first locking mechanism, a second locking mechanism configured to lock the third section relative to the second section, and a second lever near the head end, the second lever being selectively movable to unlock the second locking mechanism, wherein the first, second, and third sections comprise respective frames and mattress portions, and wherein the mattress portion associated with the second section is integral with the mattress portion associated with the third section to define a common mattress pad and the mattress portion associated with the first section is separate from the common mattress pad.

40. The patient support apparatus of claim 39, wherein a part of the common mattress pad is adapted to support a neck of the patient.

* * * * *